US006827395B1

(12) United States Patent
Wang et al.

(10) Patent No.: US 6,827,395 B1
(45) Date of Patent: Dec. 7, 2004

(54) SAFETY LOCK FOR FOLDING CHAIR

(75) Inventors: Teng Yi Wang, Taipei (TW); Chang I Wu, Taipei (TW)

(73) Assignee: Shen-Tai Industry Co., Ltd., Taipei (TW)

( * ) Notice: Subject to any disclaimer, the term of this patent is extended or adjusted under 35 U.S.C. 154(b) by 0 days.

(21) Appl. No.: 10/680,249

(22) Filed: Oct. 8, 2003

(51) Int. Cl.[7] ..... A47C 4/00
(52) U.S. Cl. ..... 297/16.1; 297/39
(58) Field of Search ..... 297/16.1, 19, 35, 297/39, 40, 53

(56) References Cited

U.S. PATENT DOCUMENTS 5,054,848 A * 10/1991 Liu ..... 297/39
5,707,105 A * 1/1998 Liu ..... 297/40
5,735,570 A * 4/1998 Tseng ..... 297/39
5,964,500 A * 10/1999 Lin ..... 297/16.1
6,062,639 A * 5/2000 Hill ..... 297/40
6,095,596 A * 8/2000 Chen ..... 297/39
6,206,462 B1 * 3/2001 Huang ..... 297/39
6,644,732 B1 * 11/2003 Lin ..... 297/39

* cited by examiner

*Primary Examiner*—Peter R. Brown
(74) *Attorney, Agent, or Firm*—Troxell Law Office PLLC

(57) ABSTRACT

A safety lock for folding chair includes a top portion and two lateral wall portions to define an open-bottomed receiving space therebetween. The safety lock is mounted to a rear end of a seat frame tube of the folding chair by extending a shaft pin through two shaft holes provided at a rear end of the safety lock and two through holes provided on the seat frame tube, so that the safety lock may be pivotally turned about the shaft pin between a lock position, in which the seat frame tube is clamped in the receiving space and the folding chair is prevented from collapsing, and a release position, in which the safety lock is turned away from the seat frame tube. The two lateral wall portions have two bottom edges that are always located at finger accessible open positions to facilitate easy turning of the safety lock.

3 Claims, 4 Drawing Sheets

SAFETY LOCK FOR FOLDING CHAIR

FIELD OF THE INVENTION

The present invention relates to a safety lock for folding chair, and more particularly to a safety lock that may be conveniently produced by way of integral injection molding and enables quick and easy operation to a lock or a release position.

BACKGROUND OF THE INVENTION

A folding chair usually includes a seat located between two lateral sides of U-shaped front and rear leg frames, two armrests movably connected to upper ends of the front and rear leg frames, and knuckle members for pivotally connecting a backrest to the leg frames or the armrests, such that the backrest, the seat, and the leg frames may be turned about the knuckle members to a folded and flat state for storage, or an extended state for use. Many children's chairs are in the form of such folding chair.

It is very possible a young and active child improperly applies a force to unexpectedly collapse the folding chair, and is unfortunately clamped between and injured by the collapsed chair. Therefore, there have been developed safety devices particularly for children's folding chairs to avoid undesired injury of children by the collapsed folding chairs.

U.S. Pat. No. 6,062,639 discloses a locking device for movably mounting at a rear end of the seat frame of the folding chair, so that the locking device may be backward turned about a pivot point to a release position, or forward turned to a lock position to bear against a joint of a lower end of the backrest and the seat frame. That is, when the locking device is turned to the lock position, it prevents a folding knuckle of the folding chair from turning and accordingly prevents the whole chair from unexpected collapsing to clamp and injure a small child using the chair. Thus, a portion of the locking device bearing against the folding knuckle must have sufficient strength and resistance to prevent the folding chair from collapsing. For this purpose, the locking device being forward turned to the lock position must firmly bear against and clamp the seat frame in a tight fit relation to prevent the locking device from undesirably loosening from the seat frame.

To use the folding chair with the above-described locking device, it is necessary to extend the chair and turn the locking device to the lock position, and to turn the locking device to the release position before collapsing the chair. Since the locking device in the lock position firmly clamps on the seat frame, a relatively large force is required to turn it away from the seat frame to the release position. Moreover, since the locking device mounted to the rear end of the seat frame is located in a very small space at the joint of the lower end of the backrest and the seat frame, even an adult would have to apply a considerably large force to turn the locking device within the small space. The conventional locking device disclosed in U.S. Pat. No. 6,062,639 is inconvenient for use.

SUMMARY OF THE INVENTION

A primary object of the present invention is to provide a safety lock for folding chair that may be integrally injection-molded for mounting on two laterally opposite sides of the folding chair, and enables quick and easy operation thereof between a lock and a release position.

To achieve the above and other objects, the safety lock for folding chair according to the present invention mainly includes a top portion and two lateral wall portions to define an open-bottomed receiving space therebetween. The receiving space has an inner width corresponding to an outer diameter of a seat frame tube of the folding chair to which the safety lock is to be mounted. A rear end of the top portion is cut out to form a recess, and two opposite shaft holes are provided at rear ends of the two lateral wall portions below the recess. The safety lock is designed for mounting to a rear end of the seat frame tube of the folding chair, such that the rear end of the seat frame tube is located between the two lateral wall portions to extend across the open-bottomed receiving space and the recess at the top portion, and the two opposite shaft holes at the rear end of the wall portions are aligned with two through holes preformed on the seat frame tube for a shaft pin to extend therethrough and pivotally connect the safety lock to the seat frame tube. And, the two lateral wall portions have two bottom edges, at where a user pushes the safety lock between a lock and a release position, being always located at finger accessible open positions to facilitate easy push of the safety lock.

In a preferred embodiment of the present invention, the two lateral wall portions of the safety lock are provided on two outer surfaces with two laterally outward extended flanges, so as to form two expanded end surfaces at a front end of the safety lock and provide increased contact surfaces at the bottom edge of the lateral wall portions to facilitate easy application of force with fingers when pushing the safety lock.

In another preferred embodiment of the present invention, the two lateral wall portions are provided on inner surfaces at predetermined positions with two opposite pads that are adapted to tightly press against the seat frame tube when the latter is extended across the receiving space and clamped between the two lateral wall portions.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
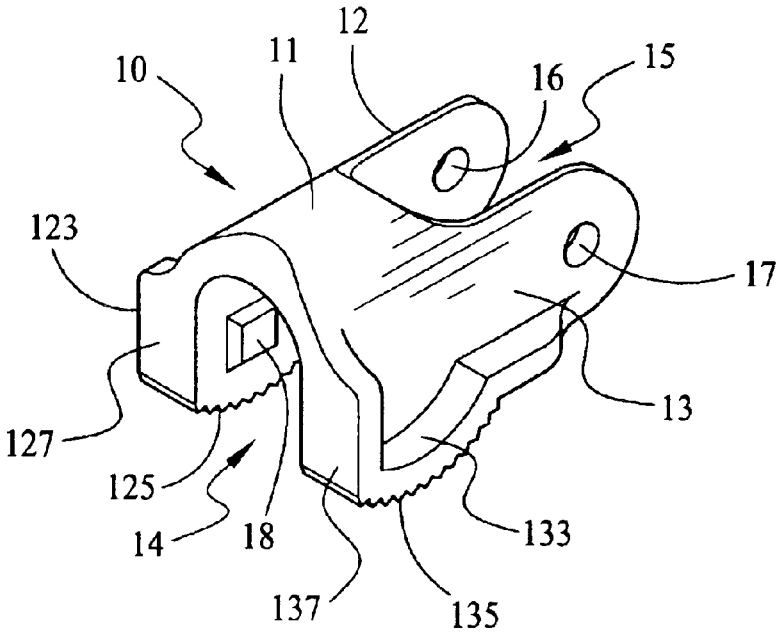
FIG. 1 is a perspective view of a safety lock for folding chair according to a preferred embodiment of the present invention.
Figure 2:
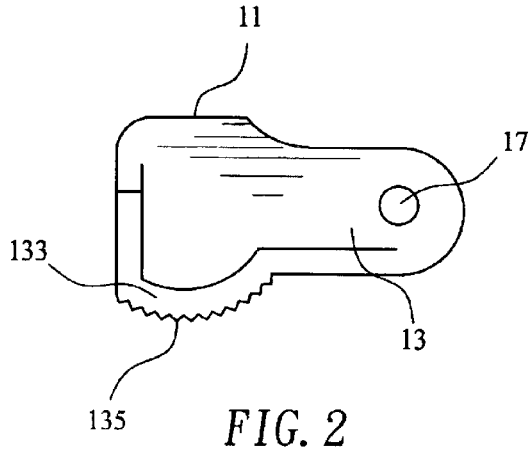
FIG. 2 is a side view of FIG. 1.
Figure 3:
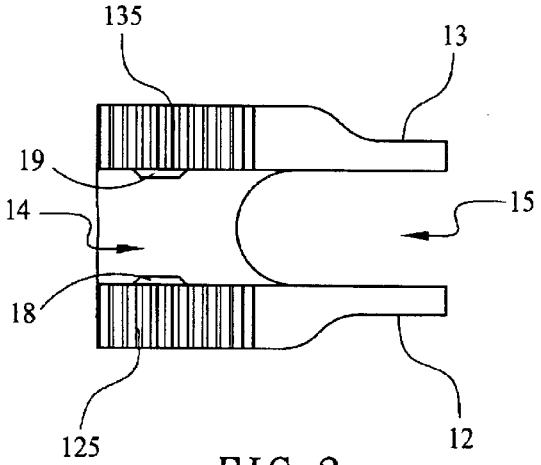
FIG. 3 is a bottom view of FIG. 2.
Figure 4:
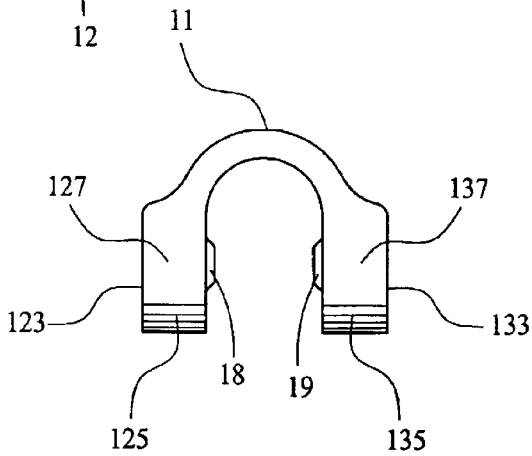
FIG. 4 is a front view of FIG. 2.

Please refer to FIGS. 1 to 4 that shows a safety lock for folding chair 10 according to a preferred embodiment of the present invention. Basically, the safety lock 10 is made of a suitable material, such as a metal or a plastic material, through integral injection molding, and includes a top portion 11 and two lateral wall portions 12, 13 to together define an open-bottomed receiving space 14 therebetween. The receiving space 14 has an inner width corresponding to an outer diameter of a chair tube to which the safety lock 10 is to be mounted. A rear end of the top portion 11 is cut out to form a recess 15, and two opposite shaft holes 16, 17 are provided at rear ends of the two lateral wall portions 12, 13, respectively, below the recess 15.

In the illustrated preferred embodiment, the two lateral wall portions 12, 13 are provided at inner surfaces with two opposite pads 18, 19 that are raised from the inner surfaces by a small height and thereby reduce the inner width of the receiving space 14 between the two pads 18, 19.

In a more preferred embodiment, the two lateral wall portions 12, 13 are provided on two outer surfaces with two laterally outward extended flanges 123, 133, respectively, which have predetermined thickness and width. The flanges 123, 133 start from two upper front ends of the safety lock 10 to extend most part of lower outer edges of the two lateral wall portions 12, 13, so as to form two expanded end surfaces 127, 137 at a front end of the safety lock 10 and provide increased contact surfaces at the lateral wall portions 12, 13 to facilitate easy application of force with fingers when pushing or pulling the safety lock 10. The two flanges 123, 133 are provided with toothed bottom surfaces 125, 135 to enable good frictional contact of the flanges with a user's fingers.

Figure 5:
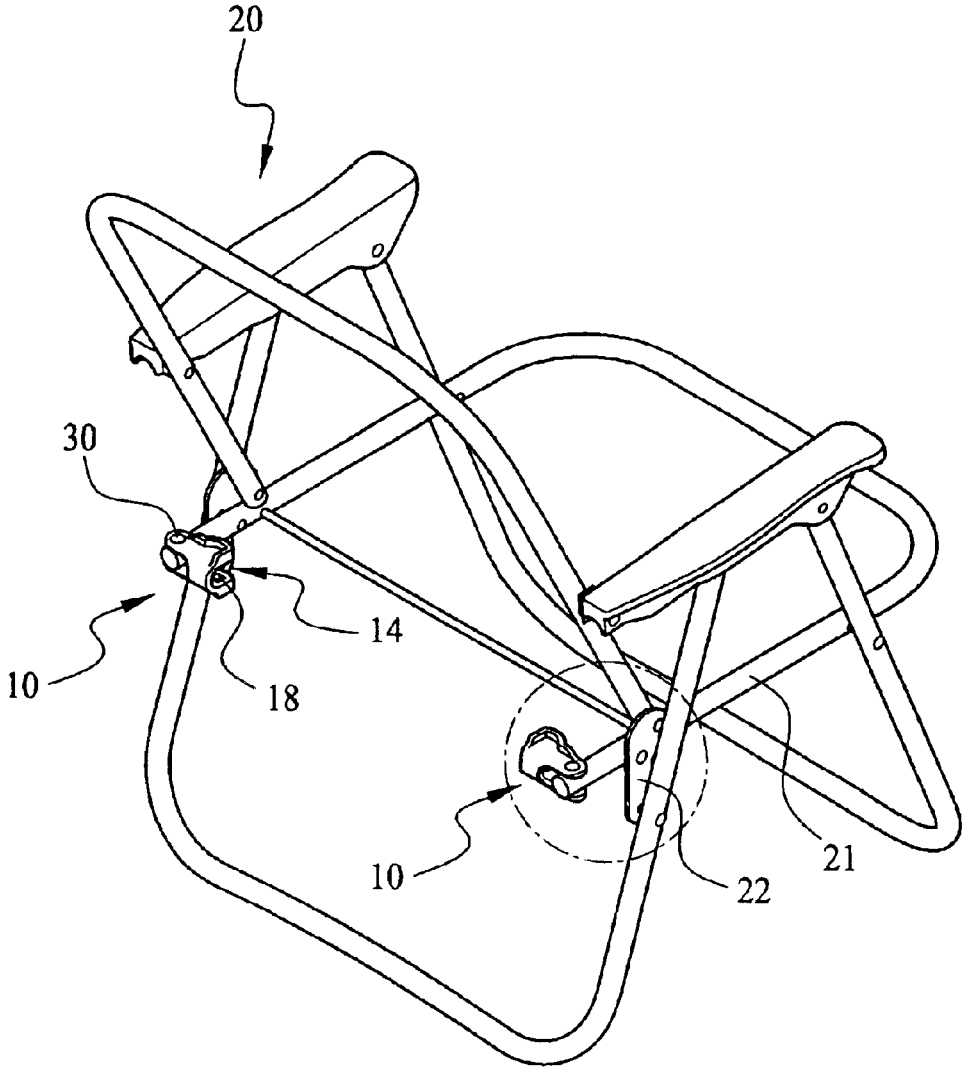
FIG. 5 shows the mounting of the safety lock of the present invention on a children's folding chair.
Figure 6:
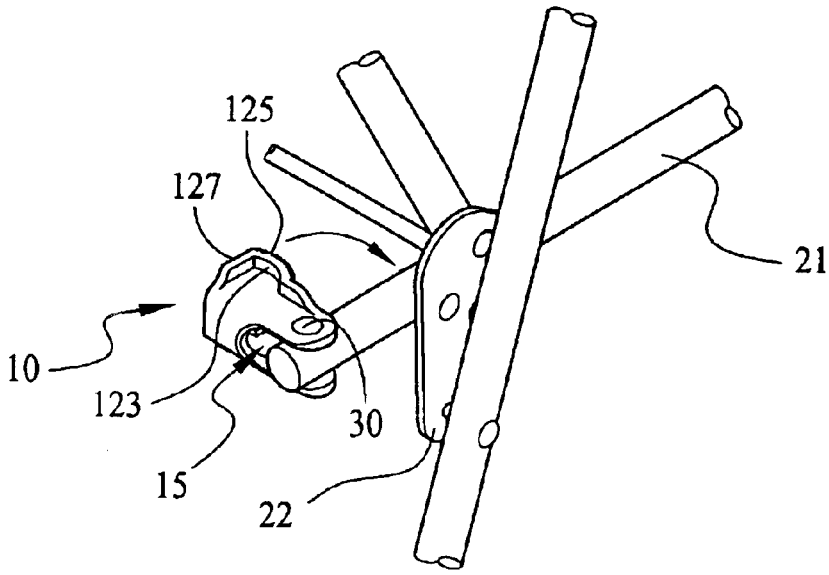
FIG. 6 is an enlarged view of the circled area of FIG. 5, wherein the safety lock is in a release position.

As can be clearly seen from FIG. 5, the safety lock 10 is designed for mounting to a rear end of a seat frame tube 21 of a folding chair 20. To mount the safety lock 10 to the seat frame tube 21, first align the recess 15 at the top portion 11 with the frame tube 21, so that the rear end of the frame tube 21 is located between the two lateral wall portions 12, 13 to extend across the open-bottomed receiving space 14 and the recess 15, then align the two opposite shaft holes 16, 17 at the rear end of the wall portions 12, 13 with two through holes (not shown) preformed on the frame tube 21, so that a shaft pin 30 may be extended through the shaft holes 16, 17 to pivotally connect the safety lock 10 to the frame tube 21. With these arrangements, the safety lock 10 may be pivotally turned about the shaft pin 30 to move outward relative to the frame tube 21 to a release position, as shown in FIGS. 5 and 6, allowing the folding chair 20 to be folded. Or, the safety lock 10 may be pivotally turned about the shaft pin 30 to move inward relative to the frame tube 21 to a lock position, as shown in FIG. 7.

Figure 7:
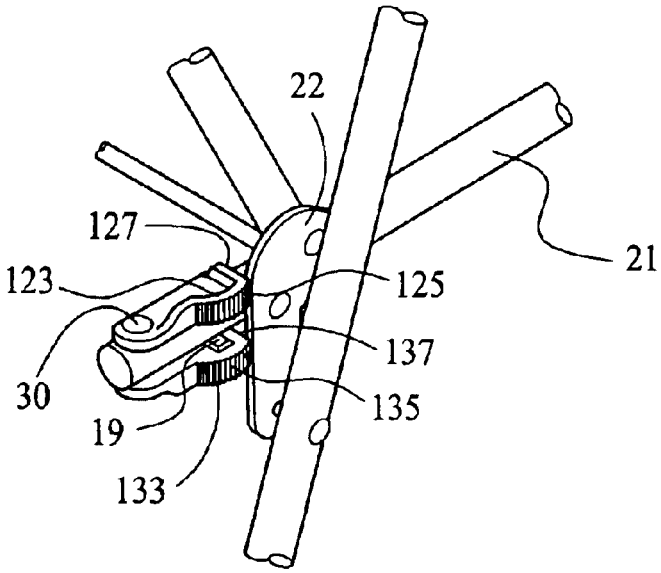
FIG. 7 shows the safety lock of FIG. 6 turned to a lock position.

Please refer to FIG. 7. When the safety lock 10 is moved to the lock position, the expanded end surfaces 127, 137 at the front end of the safety lock 10 are pressed against a knuckle plate 22 of the folding chair 20 having the seat frame tube 21, a rear leg frame, and a backrest frame pivotally connected thereto to effectively prevent the folding chair 20 from unexpected folding to dangerously clamp a small child between the collapsed tubes of the folding chair 20. Meanwhile, when the safety lock 10 is in the lock position, the flanges 123, 133 and the toothed frictional surface 125, 135 are located at an easily accessible open place on the folding chair 20 and faced outward relative to the folding chair 20. Therefore, a user may easily push the safety lock 10 at the flanges 123, 133 and the toothed frictional surfaces 125, 135 with fingers to release the safety lock 10 from the seat frame tube 21, as shown in FIG. 6, allowing the folding chair 20 to be folded. Since the flanges 123, 133 and the toothed frictional surfaces 125, 135 that are used to release the safety lock 10 from the seat frame tube 21 are located at an open position that maybe easily accessed by the user's fingers, the safety lock 10 may be very quickly and conveniently manipulated.

Moreover, when the safety lock 10 in the release position is pivotally turned about the shaft pin 30 in a direction indicated by the arrow in FIG. 6, and finally moved into the lock position as shown in FIG. 7, the seat frame tube 21 is located in the receiving space 14 and be firmly clamped between the two lateral wall portions 12, 13 utilizing an inherent elasticity of the metal or plastic material forming the safety lock 10. The pads 18, 19 provided at and raised from the inner surfaces of the lateral wall portions 12, 13 are adapted to forcefully press against the seat frame tube 21 to increase the clamping force applied by the two lateral wall portions 12, 13 to the seat frame tube 21.

Since the safety lock 10 may be integrally injection-molded for symmetrically mounting on two opposite lateral sides of the seat frame tube 21 of the folding chair 20, the folding chair 20 may be more quickly and conveniently locked from collapsing or released for folding.

The present invention has been described with a preferred embodiment thereof and it is understood that many changes and modifications in the described embodiment can be carried out without departing from the scope and the spirit of the invention that is to be limited only by the appended claims.

What is claimed is:

1. A safety lock for a folding chair with a knuckle plate comprising:

a) a top;

b) two lateral walls pivotally connected at a first end thereof to a seat frame tube of the folding chair;

c) two expanded end surfaces, one of the two expanded end surfaces located on a second end of each of the two lateral walls;

d) an open-bottom receiving space located between the two lateral side walls;

e) two curved flanges, each of the two curved flanges extending outwardly from the second end of one of the two lateral walls and connected to an adjacent one of the two expanded end surfaces; and f) two pads, each of the two pads located in the open-bottom receiving space and connected to an interior surface of one of the two lateral walls, wherein the two lateral walls are pivotal between locked and unlocked positions, when in the locked position, the seat frame tube is inserted into the open-bottom receiving space and engaged by each of the two pads, and the two expanded end surfaces engage the knuckle plate of the folding chair to prevent the folding chair from being folded and, when in the unlocked position, the seat frame tube is removed from the open-bottom receiving space to allow the folding chair to be folded.

2. The safety lock according to claim 1, wherein the top includes a recess, the seat frame tube is located in the recess when the two lateral walls are in the unlocked position.

3. The safety lock according to claim 1, wherein each of the two curved flanges includes a toothed bottom surface.

* * * * *